US007908994B2

(12) United States Patent
Herre et al.

(10) Patent No.: US 7,908,994 B2
(45) Date of Patent: Mar. 22, 2011

(54) AUTOMATICALLY STEERED COATING MACHINE ALSO A CONTAINER FOR THE COATING MATERIAL

(75) Inventors: Frank Herre, Oberriexingen (DE); Jürgen Haas, Knittlingen (DE); Hans Vetters, Pfaffenhofen (DE); Michael Baumann, Flein (DE); Thomas Hezel, Asperg (DE); Bekim Maxharraj, Bietigheim-Bissingen (DE); Nedime Maxharraj, legal representative, Bietigheim-Bissingen (DE); Jan Grigoleit, Bietigheim-Bissingen (DE); Marcus Frey, Weil der Stadt (DE); Herbert Martin, Weinstadt (DE)

(73) Assignee: Duerr Systems, Inc., Auburn Hills, MI (US)

( * ) Notice: Subject to any disclaimer, the term of this patent is extended or adjusted under 35 U.S.C. 154(b) by 1183 days.

(21) Appl. No.: 11/551,104

(22) Filed: Oct. 19, 2006

(65) Prior Publication Data

US 2008/0236484 A1 Oct. 2, 2008

Related U.S. Application Data

(60) Provisional application No. 60/729,443, filed on Oct. 21, 2005, provisional application No. 60/729,442, filed on Oct. 21, 2005.

(51) Int. Cl.
*B05C 5/02* (2006.01)

(52) U.S. Cl. ..... 118/300; 118/302; 118/323; 118/629; 239/690; 239/700; 239/104; 901/27; 901/28; 901/29; 901/43

(58) Field of Classification Search ..... 118/629, 118/300, 302, 323; 239/690, 700, 104; 901/27–29, 901/43, 323; 427/421.1, 427.2, 427.3
See application file for complete search history.

(56) References Cited

U.S. PATENT DOCUMENTS

| | | | |
|---|---|---|---|
| 2,816,822 | A | 12/1957 | Hess et al. |
| 4,708,580 | A | 11/1987 | Akeel |
| 4,879,137 | A | 11/1989 | Behr et al. |
| 4,932,589 | A | 6/1990 | Diana |
| 4,977,911 | A | 12/1990 | Vetter et al. |
| 5,076,769 | A | 12/1991 | Shao |
| 5,238,029 | A | 8/1993 | Akeel |
| 5,293,911 | A | 3/1994 | Akeel |
| 5,367,944 | A | 11/1994 | Akeel et al. |
| 5,944,045 | A | 8/1999 | Allen et al. |
| 7,051,950 | B2 | 5/2006 | Giuliano |
| 2004/0249508 | A1 | 12/2004 | Suita et al. |
| 2005/0092238 | A1 * | 5/2005 | Ueno et al. ..... 118/621 |

FOREIGN PATENT DOCUMENTS

DE 19524853 1/1996

(Continued)

OTHER PUBLICATIONS

International Search Report dated Jul. 2, 2008 EP05111273.

*Primary Examiner* — Laura Edwards
(74) *Attorney, Agent, or Firm* — Rader Fishman Grauer

(57) ABSTRACT

The piston dispenser for the measured supplying of material to the atomizer of a painting robot is arranged in the hand joint of the robot. Various feasible embodiments of the dispensing cylinder of this piston dispenser are described.

24 Claims, 5 Drawing Sheets

FOREIGN PATENT DOCUMENTS

| | | | | |
|---|---|---|---|---|
| DE | 69228249 | T2 | | 12/1999 |
| DE | 19937426 | | | 3/2001 |
| DE | 10103067 | | * | 7/2002 |
| DE | 10110098 | | | 9/2002 |
| DE | 102004043014 | | | 3/2006 |
| EP | 0366021 | | | 5/1990 |
| EP | 0443276 | | | 8/1991 |
| EP | 0693319 | | | 1/1996 |
| EP | 0796664 | | | 9/1997 |
| EP | 0796665 | | | 9/1997 |
| EP | 0967016 | | | 12/1998 |
| EP | 1245294 | A2 | | 10/2002 |
| EP | 1279440 | | | 1/2003 |
| EP | 1285733 | | | 2/2003 |
| EP | 1314483 | | | 5/2003 |
| EP | 1360996 | | | 5/2003 |
| EP | 1362642 | | | 5/2003 |
| EP | 1367302 | | | 12/2003 |
| EP | 1369183 | A2 | | 12/2003 |
| EP | 1384885 | | | 1/2004 |
| WO | WO2004037436 | | | 5/2004 |

* cited by examiner

AUTOMATICALLY STEERED COATING MACHINE ALSO A CONTAINER FOR THE COATING MATERIAL

CROSS-REFERENCE TO RELATED APPLICATIONS

This application claims the benefit of U.S. Provisional Patent Application Ser. No. 60/729,443 filed on Oct. 21, 2005, and also claims the benefit of U.S. Provisional Patent Application Ser. No. 60/729,442 filed Oct. 21, 2005 which is incorporated by reference herein in its entirety.

FIELD OF THE INVENTION

The invention concerns an automatically controlled coating machine for the mass production coating of work pieces and, in particular, a painting robot for the painting of work pieces such as automotive bodies with an electrostatic or other type of atomizer.

BACKGROUND

During the electrostatic coating with direct charging of an electrically conductive coating material of varying color, it is known to employ an intermediate reservoir for the necessary potential separation between the grounded color changer, which consists of a valve arrangement, and the atomizer, which is placed under high voltage. The reservoir can be filled by the color changer as long as the high voltage on the atomizer has been switched off or the connection line to the atomizer has been emptied, and before the atomizer under high voltage is supplied with material it is first necessary to form an insulated stretch between the reservoir and the color changer, for example, by emptying the supply line of the reservoir i.e. (EP 0 292 778, U.S. Pat. No. 4,932,589, DE 199 37 426, EP 1 314 483 etc.). It is especially expedient for this intermediate reservoir to be configured as a dispensing cylinder for the precisely measured supply of material to the atomizer.

In a painting robot known from WO 2004/037436, the intermediate reservoir is located together with the color changer in the forearm of the robot, consisting of insulation material. In lieu of this, it is also known to arrange dispensing cylinders or a reservoir such as one in the form of a spiral hose joined to a dispensing pump in the atomizer itself, and in the case of dispensing cylinders, the atomizer and/or the dispensing cylinder is interchangeably installed i.e. (EP 0 693 319, EP 0 967 016, EP 1 279 440, EP 1 245 294). On the other hand, as is familiar, dispensing cylinders can also be placed outside of the coating machine, for example, on its outside or on an outer wall of the spray booth i.e. (EP 1 362 642, EP 1 360 996).

Furthermore, from EP 0 796 664 it is known to employ cartridge-like reservoirs configured as dispensing cylinders in the robot arm to supply the paint for painting robots; these are not filled in the robot, but rather after being used they are automatically replaced by new cartridges which have been filled outside. For example, per EP 0 796 665, the cartridges can be connected to a color changer at the external filling station.

If the reservoir is required to be arranged in a movable part of the coating machine, from which it can be removed, it is advisable for it to be taken automatically by the machine itself to a removal station. The removing of a reservoir may be required not only because of the reasons given in the cited EP 0 796 664 and 0 796 665, but also for reasons of maintenance or to replace a faulty reservoir, for example. Moreover, it may be advisable to fill the reservoir in normal operation, and especially for frequently required paint colors, at its operating position within the machine and only to replace it with a different, already filled reservoir in special cases, for example, for special colors. In these situations, with the reservoir arranged in the robot's arm, one has had to be satisfied with the movement capabilities of the latter. While arranging the reservoir in the atomizer provided many more degrees of freedom of motion (axes), this would make the atomizer heavy and bulky, which is detrimental to the movement dynamics, the loading of the axes of the hand joints, and also the accessibility of narrow or hard to reach areas on the work piece, such as interior regions of car bodies.

Another problem in all painting machines of this kind is the wasting of paint and rinse agents which may occur primarily when changing colors in the connection line leading from the reservoir to the atomizer and which will depend on the length of the latter.

SUMMARY OF THE INVENTION

The basic problem of the invention is to indicate a coating machine characterized by the lowest possible waste of material and by optimized movement capabilities for the reservoir.

This problem is solved by the features of the present invention. According to the invention, one can avoid the drawbacks of arranging the dispensing cylinders and other containers for paint or other material in the atomizer or, alternatively, inside or outside of the coating machine, by arranging them in the hand joint, on which the atomizer is mounted.

The preferred location for the reservoir, according to the invention, is the first axial member of the hand joint, mounted so that it can rotate at the end of the forearm in a conventional painting robot. The three degrees of freedom of a triaxial robot hand joint also termed the hand axes, are usually designated as axis 4, axis 5 and axis 6; those of a quadraxial hand joint are designated as axes 4, 51, 52 and 6. Thus, the reservoir should preferably lie between axes 4 and 5, or 51, of the hand joint. In the context of the invention, however, a hand joint with only two axes can also be contemplated, i.e., with only one axial member containing the reservoir, mounted so that it can rotate on the robot arm, with the atomizer mounted so that it can rotate on its end flange.

As compared to the known arrangement of the reservoir in the robot arm, the invention has the advantage that the much shorter line from the reservoir to the atomizer greatly reduces losses during paint color changes, and at the same time the axis 4 provides an additional degree of freedom for the movement of the reservoir when it is necessary for the machine to take the reservoir to a maintenance or removal station for one of the mentioned reasons. The invention is based on the knowledge that no changes in desirable small and lightweight atomizers are needed for these benefits. For example, in the case of a reservoir in the form of a piston dispensing cylinder, it is also practical to install this in the hand joint, even though the reservoir is rotated in operation due to the movement of the axis 4 relative to the robot arm, which contains the dispensing drive unit and also usually the paint supply line from the color changer or at least (when installed in the hand joint) the supply lines leading to the color changer.

The installing of the color changer as well in the hand joint shortens the connection line to the reservoir and thus also contributes to reducing paint change losses here.

If one arranges two reservoirs instead of just one in the hand joint, this makes possible the alternating operation of the two reservoirs as is familiar from the above cited prior art (A/B operation), wherein to prevent an interruption in the coating process due to emptying of the reservoir, the one reservoir is replenished while the atomizer is being supplied from the other reservoir. The two reservoirs can be arranged separately from each other on either side of the lines running through the interior of the hand joint to the applicator, i.e., especially the usual hoses for liquid, powderlike and gaseous media, electrical signal and high voltage cables, and optical fibers. According to one additional feature of the invention, however, it is possible to use only a single reservoir, configured more space-saving than A/B piston dispensers.

The reservoir or reservoirs arranged in the hand joint can be configured, in the context of the invention, with mechanical, pneumatic or hydraulic drive, or in some other manner, rather than being piston dispensing cylinders. For example, it is possible to configure the reservoir in familiar manner as a space-saving hose winding or spiral tube; or in the case of two reservoirs for A/B operation, for example, one will prefer double spirals, whose turns are nested one in the other and/or wound in at least two layers. The winding can be "pigged", again in familiar manner, and the pig shoved through the spiral line can serve to clean the line and/or also as a dispensing piston for a measured emptying of this spiral reservoir, if it is actuated in turn by a dispensing fluid. Furthermore, in the case of electrostatic coating with electrically conductive paints, using a spiral hose or tube made of insulating material, the required potential separation between the atomizer and the grounded paint supply system can also be implemented with the least possible space.

Other applications of the present invention will become apparent to those skilled in the art when the following description of the best mode contemplated for practicing the invention is read in conjunction with the accompanying drawings.

BRIEF DESCRIPTION OF THE DRAWINGS

The invention shall be explained more closely by the sample embodiment depicted in the drawing. This shows.

The description herein makes reference to the accompanying drawings wherein like reference numerals refer to like parts throughout the several views, and wherein.

DETAILED DESCRIPTION

Figure 1:
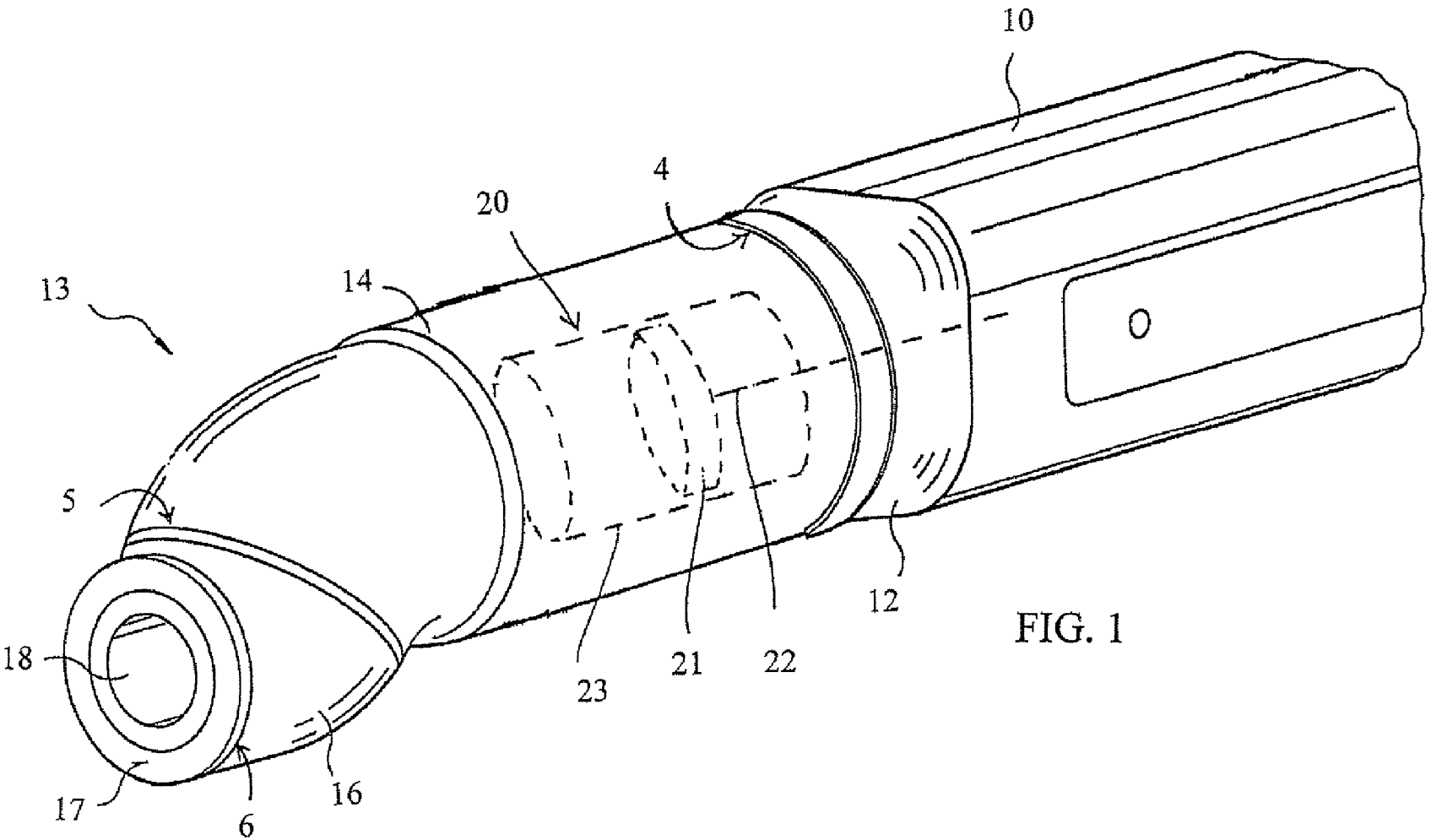
FIG. 1, the end of the painting arm of a painting robot and its hand joint.

The front part of the arm 10 of a painting robot depicted in FIG. 1 has a flange 12 at its end, on which is fastened the triaxial hand joint 13, also often termed the hand axis. The hand joint 13 consists of the first axial member 14, mounted so that it can rotate on the flange 12 of the arm 10, and the second axial member 16, able to rotate relative to the axial member 14. The hand joint or at least its axial members are generally configured as basically inseparable units. The three degrees of freedom of the hand joint 13 are denoted as axes 4, 5 and 6, as is usual with robots. On the flange 17 of the second axial member 16, and able to rotate relative to it, is mounted the atomizer (not depicted) of the painting robot on the hand joint 13, which is usually detachable and in many instances it can be automatically replaced by another atomizer. Depicted 18 is the conduit opening for the usual cables, hoses and other lines running through the hand joint on the inside, to and from the atomizer. The robot arm 10 and the hand joint 13 can be made from insulating material or can be furnished with an insulation sheath. To the extent thus far described, the depicted arrangement can correspond to familiar designs i.e. (EP 1 334 775).

Likewise in familiar fashion, a piston dispenser 20 is provided for supplying material to the atomizer with dispensing controlled continuously in dependence on the particular region of the work piece being coated, whose piston 21 can be actuated by a program-controlled dispensing drive unit for this purpose. The electric motor of this dispensing drive unit can preferably be situated together with the axis drive motors of the hand joint 13 in a chamber protected against explosion by forced ventilation at the end of the robot arm 10 opposite the hand joint and not visible in FIG. 1 and actuate the piston rod 22 of the piston dispenser 20 via a threaded spindle, a rigid or flexible shaft, or some other connection device extending through the arm. At the exit of the piston dispenser 20 there is connected a line leading through the conduit opening 18 to the atomizer.

The invention illustrated in FIG. 1 differs from known painting robots primarily in that the dispensing cylinder 23 of the piston dispenser 20 is situated in the first axial member 14 of the hand joint 13 and the piston 21 is actuated by a drive element extending through the plane of the axis 4.

The piston rod 22 extends, in the depicted example, centrally and coaxially to the axis of rotation of the axial member 14 from the hand joint 13 into the robot arm 10. In view of the relative rotations between the arm 10 and the axial member 14, a rotary bearing can be provided here for the piston rod on the axis 4. A rotary bearing can also make sense when a rotating threaded spindle or shaft is passed through the axis 4. On the other hand, the possibility exists that the automatic machine controls will compensate for the rotation of the axial member by appropriately controlling the dispensing drive unit when the threaded spindle or shaft is rotated by the piston dispensing drive and at the same time the axial member containing the dispensing cylinder rotates relative to the machine arm. Thus, this compensation involves an electrical or cybernetic uncoupling of two mechanically coupled rotary elements by overdriving the rotary movement of the piston drive element in dependence on the rotary movements of the axial member.

Figure 2:
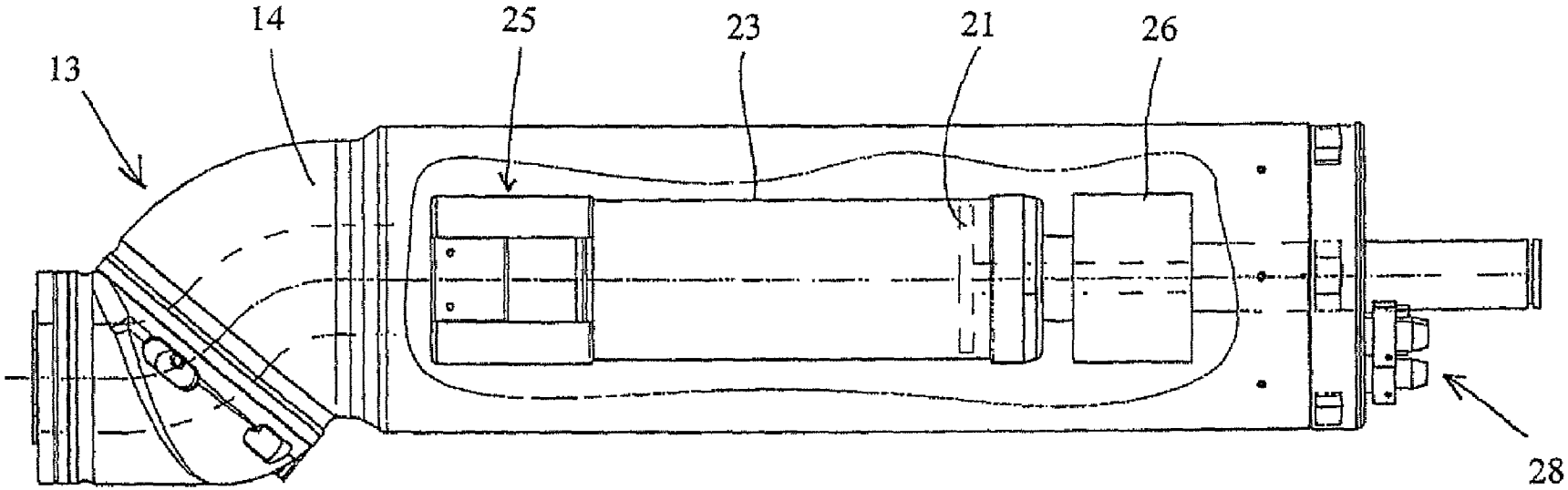
FIG. 2, an exploded view of one axial member of the hand joint, in which a dispensing cylinder can be seen.

One possible form and position of the dispensing cylinder 23 only schematically indicated in FIG. 1 in the axial member 14 of the hand joint 13 is shown more precisely in FIG. 2. At its one end, a valve arrangement 25 automatically controlled by the control program of the coating system can be provided for the inlets and/or outlets of the dispensing cylinder. The unit 26 depicted at the other end can contain, for example, a back gear to actuate the dispensing piston 21, being actuated by the dispensing drive unit. Furthermore, or instead of this, the unit 26 can also contain components of the paint supply system of the atomizer and in particular the customary color change valve arrangement (color changer), which is thus likewise situated in the hand joint in this sample embodiment. At 28 are shown customary coupling elements for the drive shafts of the hand joint axes. The dispensing cylinder 23 can consist of ceramic, as is typical i.e. (EP 1 384 885).

The inlet lines of the color changer and the other lines running from the robot arm 10 into the hand joint 13 and to the atomizer, such as electrical and optical signal conductors, hoses for liquid and gaseous media, high tension cables and the like, are advisedly arranged centrally, i.e., as close as possible to the axis of rotation of the axial member 14 (axis 4). Inside the axial member 14, the lines can then run radially outward from the center axis and be led axially along the outside of the dispensing cylinder 23, when this is situated centrally in the axial member 14. Such an arrangement of the lines L between the dispensing cylinder 23 and the coaxial cylindrical inner wall of the axial member 14 is shown in FIG. 3.

For the inlet lines of the color changer in the axial member 14, as well as for the other lines, one can adopt familiar solutions for torque uncoupling and/or other solutions to avoid unwanted torsional loads i.e. (EP 1 285 733 and DE 10 2004 043 014).

When the lines are led centrally, the dispensing cylinder could also be arranged off-center next to the lines in the axial member 14, for example, immediately against its inner wall. In this case, its piston rod could be driven by a central input drive element across a radial coupling member.

Figure 4:
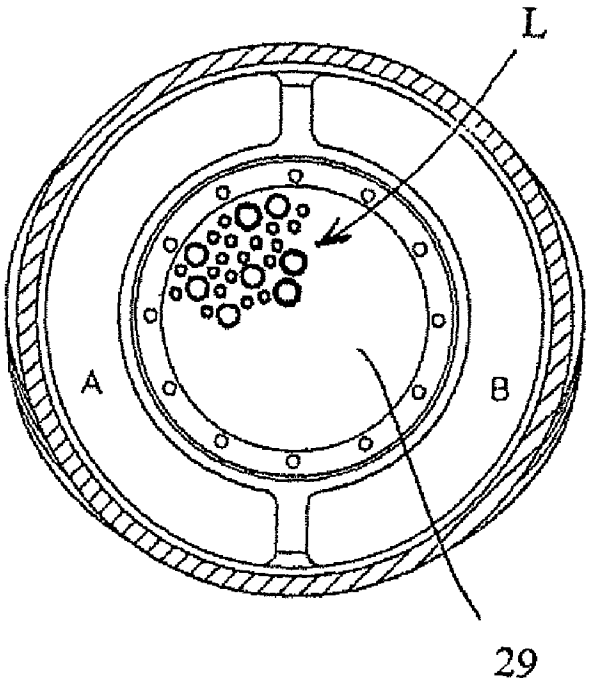
FIG. 4, a cross section through the axial member in an embodiment with two dispensing cylinders.
Figure 3:
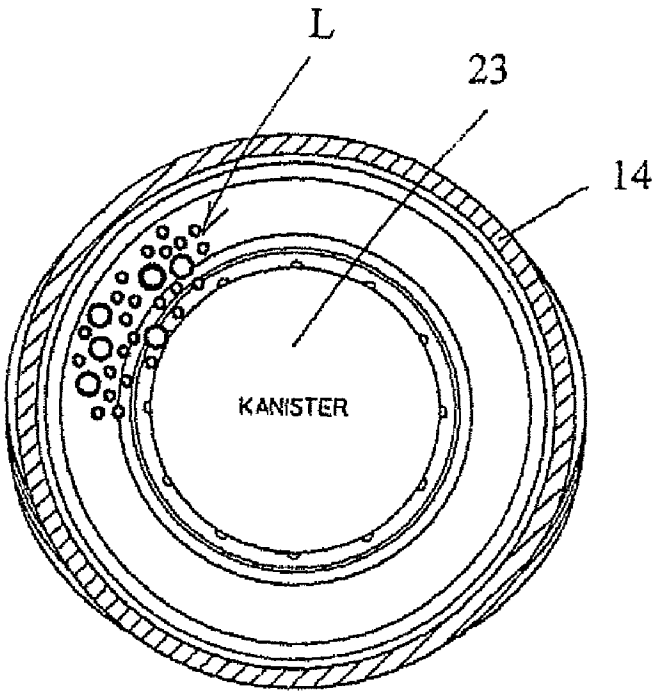
FIG. 3, a cross section through the axial member of the hand joint with the dispensing cylinder in one possible embodiment.

Instead of the arrangement shown in FIG. 3, however, the possibility also exists of designing the dispensing cylinder, arranged coaxially to the axis of rotation of the axial member 14, with a ring shape in cross section, and leading the lines centrally through the cylindrical (for example) interior of this ring body. A modification of this sample embodiment, in which not only a dispensing cylinder but also two reservoirs A and B separated from each other are situated in the axial member 14, is shown in FIG. 4. Accordingly, the two reservoirs can be in the shape of approximately a partial circular ring or kidney shaped in cross section and be arranged facing each other on opposite sides of the center axis of the axial member 14, so that the passageway 29 for lines L running to the atomizer is formed between them.

As already mentioned above two dispensing cylinders hooked up in parallel between the color changer and the atomizer make possible the typical A/B operating mode, in which the atomizer can be supplied continuously or quasi-continuously without interrupting the coating operation by the need to replenish the reservoirs.

Figure 5:
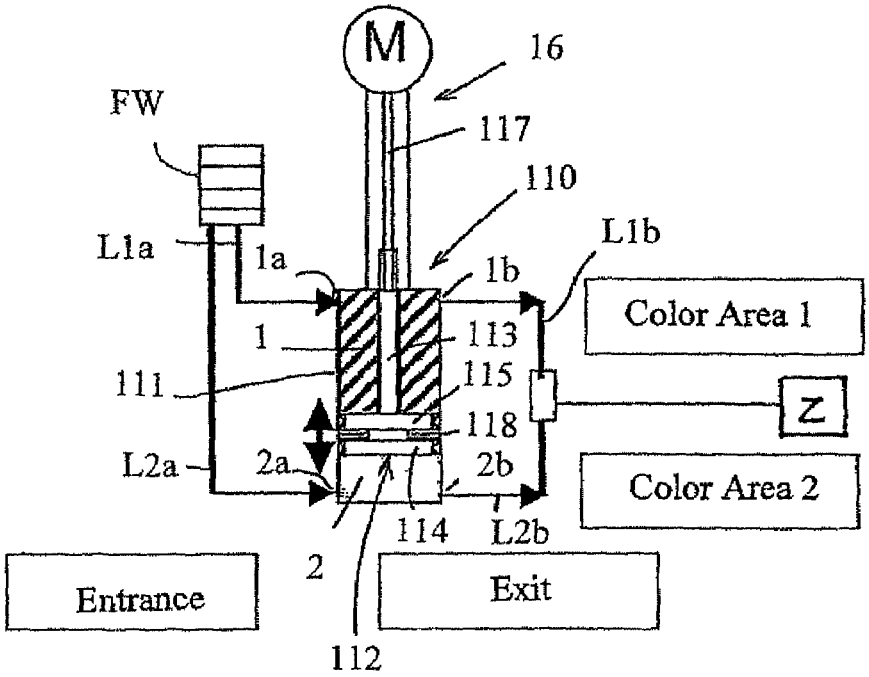
FIG. 5, a supply system for an atomizer with a first embodiment of a piston dispenser suitable for installation in the hand joint of a painting robot.
Figure 6:
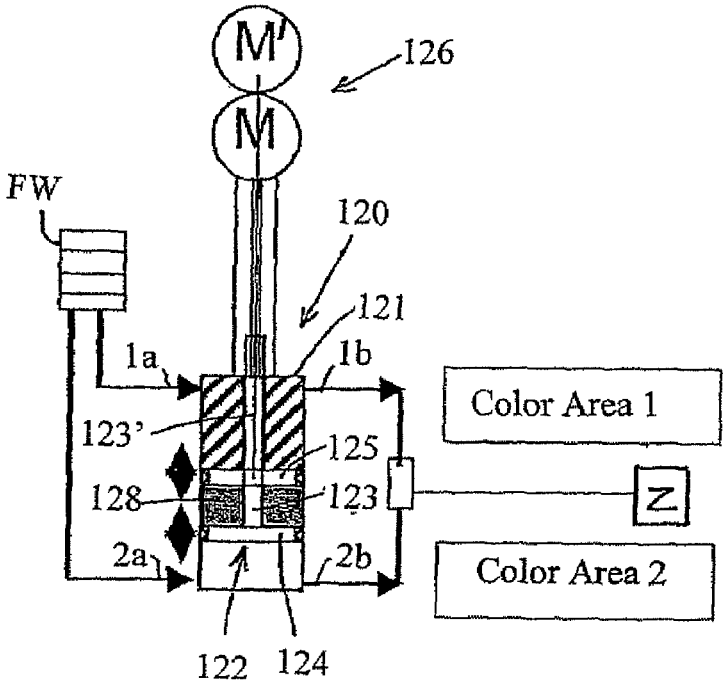
FIG. 6, a second embodiment of the piston dispenser of the supply system, otherwise corresponding to FIG. 5.

FIGS. 5 and 6 show two embodiments of a piston dispenser for A/B operation which is especially suitable for installation in the hand joint 13, since it is space-saving. The space saving is achieved in that not just one inlet and one outlet are provided as formerly when using a single dispensing cylinder, but instead two inlets for connection to the color changer and two outlets to the atomizer. In other words, instead of the known piston dispenser with its single operation, the invention uses a dual-action piston dispenser, whose pistons deliver material to the atomizer during each of its two counteracting movements. For electrostatic systems, the piston dispenser contains two piston elements, between which a high voltage-proof insulating element or insulating medium is placed.

In the more simple embodiment shown in FIG. 1, a single dispensing drive unit is sufficient for the piston arrangement of the dispensing cylinder, so that not only is the space requirement, but also the operating expense is cut in half as compared to the known A/B systems.

The piston dispenser 110 of the coating system, such as a painting robot, shown in FIG. 5, is hooked up between a color changer FW consisting of the customary (double) valve arrangement and an equally customary atomizer Z. The atomizer can be, for example, a rotational atomizer or pneumatic atomizer and it can work electrostatically or without high voltage. The color changer is grounded in electrostatic coating systems.

The piston dispenser 110 basically consists of the dispensing cylinder 111 with a piston arrangement 112 which can move in the dispensing cylinder, and in the embodiment considered here it is formed by two piston elements 114 and 115 joined firmly to each other and to a piston rod 113. The dispensing cylinder 111 can consist of ceramic and have, for example, a circular or oval cross section. The two piston elements 114 and 115 have a shape corresponding to this cross section and lie at their contour with sealing lips against the inner walls of the dispensing cylinder 111. To operate the piston arrangement 112, there is a dispensing drive unit 116 arranged outside the dispensing cylinder, which can consist of an electric step motor M with corresponding gearing and a threaded spindle 117, controlled by the program controls of the coating system, for example. Instead of this, other drive mechanisms known for this purpose can also be adopted.

According to the invention, a preferably liquid and preferably paint-compatible insulating medium is located in the intermediate space 118 left open between the two piston elements 114 and 115 and sealed off from the outside by their sealing lips. The volume of the insulating medium is large enough to ensure the required electrical insulation between the regions 1 and 2 of the dispensing cylinder 111, formed at either side of the piston arrangement 112, one of which can contain coating material placed under high voltage on the order of 100 kV and the other coating material placed at ground potential. When the space between the piston elements 114 and 115 is large enough, the desired high voltage insulating stretch could also be formed by air or some other insulating gas.

Each of the two regions 1 and 2 is connected by one inlet 1*a* or 2*a* and an attached inlet line L1*a* or L2*a* to the color changer and by one outlet 1*b* or 2*b* and an attached outlet line L1*b* or L2*b* to the atomizer. The inlet 1*a* and the outlet 1*b* are situated at the end face of the dispensing cylinder 111 or in its proximity, while the inlets and outlets 2*a* and 2*b* can be situated at the opposite end face of the dispensing cylinder or in its proximity. The inlets and outlets can be arranged, for example, in the cylindrical lateral wall or in the end walls of the dispensing cylinder and are opened and closed by program-controlled valves (not shown).

The inlet lines L1*a* and L2*a* and/or the outlet lines L1*b* and L2*b* can serve in familiar manner to separate the potential between the atomizer and the color changer and in special circumstances they can be designed at least in part as space-saving and preferably "piggable" spiral hoses or tubes, similar to the already mentioned possibility of designing at least one reservoir as itself being a spiral hose or tube.

The coating system of FIG. 6 corresponds to that of FIG. 5, except for the piston dispenser 120, which differs from the piston dispenser 10 in regard to the piston arrangement 122 and the dispensing drive unit 126. The piston arrangement 122 in this embodiment is formed by two piston elements 124 and 125, which can move both jointly and also relatively to each other in either direction in the dispensing cylinder 121 and are each fastened to their own piston rod 123 or 123' for this purpose. Each piston element 124 and 125 has its own program controlled motor M or M', which can actuate the respective piston rod, similar to FIG. 5, for example.

In this embodiment as well, a preferably liquid insulating medium 128 is located between the two piston elements 124 and 125, yet whose volume should change here with each shifting of the piston elements relative to each other. For example, the insulating medium 128 for this purpose can be taken periodically or continuously into or through the varying intermediate space between the piston elements 124 and 125 under control of its own dispensing device (not shown), which moves the piston elements together or apart, and its volume will increase or decrease in accordance with the piston movements. Thanks to the deliberate changing of the volume of the insulating medium 128, the fill volume of the regions 1 and 2 of the dispensing cylinder can also be adjusted, e.g., as a function of the work piece or region of the work piece being painted, and the decrease in the fill volume in region 1 can also be compensated in region 2 (unlike the case in FIG. 5) by the volume of the piston rods 123, 123'.

Figure 7:
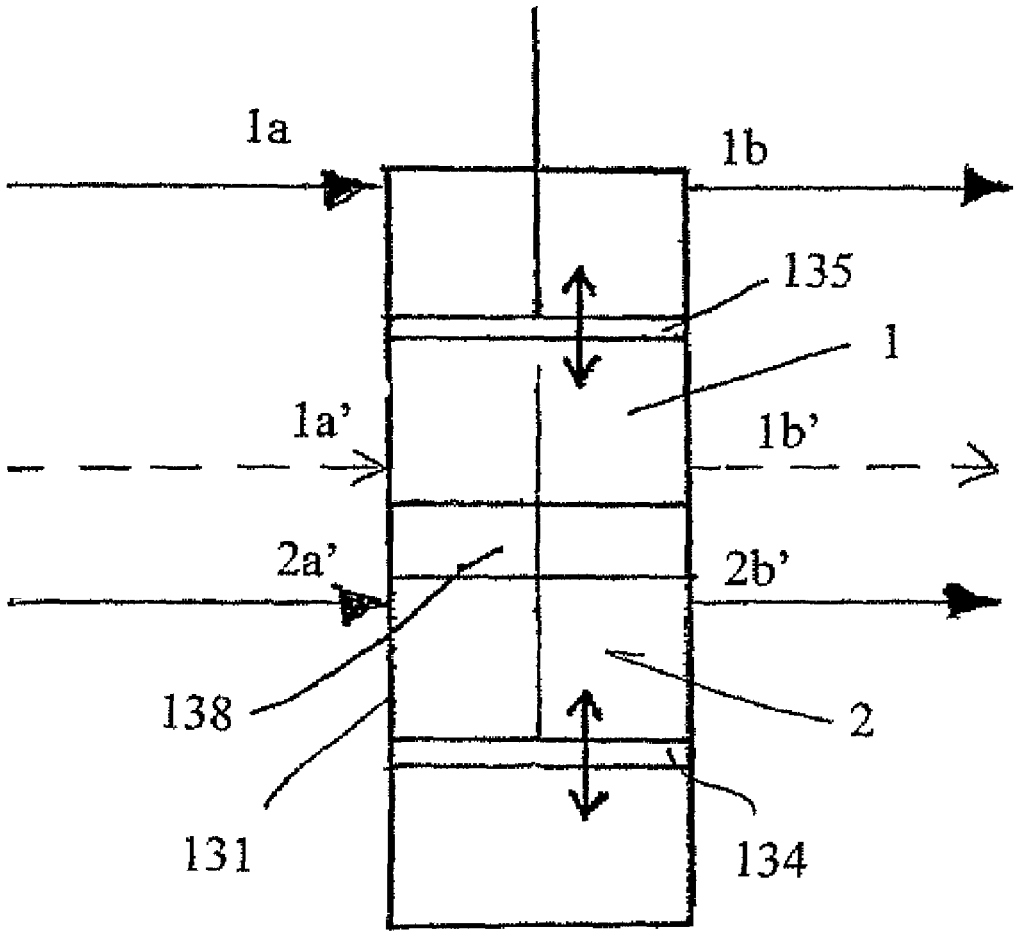
FIG. 7, another embodiment of the piston dispenser.

The embodiment of FIG. 6 can be modified in regard to the location of at least two of the four inlets and outlet lines per FIG. 7. Here as well, there are two piston elements 134 and 135, each driven by their own dispensing motor and able to move in either direction and also relatively to each other. For example, the inlet 2*a* and the outlet 2*b* can be situated in this modification, but as depicted, at a central axial position of the dispensing cylinder 131, while the inlets and outlets 1*a* and 1*b* of the other region of the dispensing cylinder can likewise be situated either at the corresponding end face or, instead, as indicated by the inlet 1*a*' and the outlet 1*b*', also at a central axial position of the dispensing cylinder 131. In either case, the same mode of operation as in the embodiment of FIG. 6 is possible, if the two cylinder regions 1 and 2 are separated from each other by an insulating element 138. The insulating element 138 can contain an insulating liquid and be arranged stationary, but an arrangement controlled from the outside with varying volume of the insulating element is also conceivable. One of the two piston rods 133 and 133' could be led through the insulating element 138 in sealed manner and then extend in the same direction as the other piston rod.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A coating machine for mass production coating of work pieces, comprising:

a movable mechanical arm, a multi-axial hand joint mounted on the mechanical arm, having an axial member able to rotate, mounted on the mechanical arm, an applicator for a coating material, mounted on the hand joint, and at least one reservoir for the coating material, connectable to the applicator by a connection line in order to supply material to the latter, wherein the at least one reservoir is arranged in the hand joint, wherein the reservoir contains a movable cylinder piston and there is a dispensing drive unit connectable to the cylinder piston for a measured supply of material to the applicator through the connection line.

2. The coating machine of claim 1, wherein the reservoir connects to an outlet line of a material change valve arrangement, whose valves are connected to lines for different coating material.

3. The coating machine of claim 2, wherein the material change valve arrangement is also arranged in the hand joint.

4. The coating machine of claim 3, wherein a torque uncoupling is provided for an inlet lines of the material change valve arrangement between the mechanical arm and an axial member containing the material change valve arrangement.

5. The coating machine of claim 1, wherein the reservoir is situated in an axial member, and the axial member is mounted for rotation on the mechanical arm.

6. The coating machine of claim 1, wherein the cylinder piston can be moved in the reservoir by a dispensing drive mechanism that is located in a space of the mechanical arm.

7. The coating machine of claim 6, wherein an elongate member extends from the mechanical arm into the hand joint to actuate the piston.

8. The coating machine of claim 7, wherein the elongate member extending from the mechanical arm into the hand joint is arranged in the vicinity of the axis of rotation of an axial member mounted on the mechanical arm.

9. The coating machine of claim 7, wherein the elongate member and the reservoir can rotate relative to each other and a pivoting bearing is provided for the elongate member.

10. The coating machine of claim 7, further comprising a machine control configured to compensate for the rotation of the axial member by controlling the dispensing drive unit when the elongate member is rotated by the piston drive and at the same time the axial member containing the reservoir rotates relative to the mechanical arm.

11. The coating machine of claim 1, wherein an electric motor of the dispensing drive unit is situated in a chamber of the mechanical arm protected against explosion by excess pressure.

12. The coating machine of claim 11, wherein electric drive motors of the hand joint axes are also arranged in the explosion-protected chamber.

13. The coating machine of claim 1, wherein the reservoir is formed by one of a spiral hose winding and a spiral tube.

14. The coating machine of claim 1, wherein lines running through the hand joint to the applicator are laid through the reservoir.

15. The coating machine of claim 14, wherein the reservoir has a longitudinal axis and is configured in a ring shape in cross section transversely to the longitudinal axis.

16. The coating machine of claim 1, wherein the hand joint contains two reservoirs, from which the applicator can be supplied alternately in duty.

17. The coating machine of claim 16, wherein the two reservoirs are in a shape of approximately one of, a partial circular ring and kidney shaped in cross section transversely to a longitudinal axis and are arranged facing each other on opposite sides of the axial member, so that a passageway in the axial member for lines running to the applicator is formed between the reservoirs.

18. The coating machine of claim 1, wherein the reservoir is arranged in the hand joint so as to be automatically replaceable by another reservoir.

19. The coating machine of claim 1, wherein the at least one reservoir is made of insulating material.

20. The coating machine of claim 1, wherein the hand joint is made of insulating material or is provided with an insulating sheath.

21. The coating machine of claim 1, wherein the mechanical arm is made from insulating material.

22. A coating machine for mass production coating of work pieces, comprising:

a movable mechanical arm, a multi-axial hand joint mounted on the mechanical arm, having an axial member able to rotate, mounted on the mechanical arm, an applicator for a coating material, mounted on the hand joint, and at least one reservoir for the coating material, connectable to the applicator by a connection line in order to supply material to the latter, wherein the at least one reservoir is arranged in the hand joint;

wherein the reservoir is a dispensing cylinder with inlets and outlets for automatically controllable connection to inlet and outlet lines, with a piston arrangement that can move in a dispensing cylinder and with at least one drive element, by which the piston arrangement is connectable to an automatically controlled dispensing drive unit, and the dispensing cylinder has two inlets and two outlets, by which it is deliberately connectable to the inlet and outlet lines, and one inlet and one outlet are situated at an axial position of the dispensing cylinder, haying an axial distance from the other inlet and from the other outlet.

23. The coating machine of claim 22, wherein certain inlets and outlets are situated at least in proximity to one end face of the dispensing cylinder and other inlets and outlets are situated at least in proximity to the opposite end face of the dispensing cylinder.

24. The coating machine of claim 22, wherein two regions are formed in the dispensing cylinder, which are connected in controlled fashion by one inlet to the inlet line arrangement and by one outlet to the outlet line arrangement, and the coating material is delivered alternately to the coating device from one of the two regions through its outlet, while at the same time the other region is being filled through its inlet.

* * * * *